US008801494B2

(12) United States Patent
Olumide

(10) Patent No.: US 8,801,494 B2
(45) Date of Patent: Aug. 12, 2014

(54) UNDERGARMENT WITH A WEIGHT SUSPENSION MEANS

(75) Inventor: Olumuyiwa Olumide, Towson, MD (US)

(73) Assignee: Olumuyiwa Olumide, Towson ( * ) Notice: Subject to any disclaimer, the term of this patent is extended or adjusted under 35 U.S.C. 154(b) by 184 days.

(21) Appl. No.: 13/347,715

(22) Filed: Jan. 11, 2012

(65) Prior Publication Data

US 2013/0178133 A1 Jul. 11, 2013

(51) Int. Cl.
*A41C 3/08* (2006.01)
*A41C 3/06* (2006.01)

(52) U.S. Cl.
CPC ..... *A41C 3/06* (2013.01)
USPC ..... 450/28; 450/6; 450/32

(58) Field of Classification Search
CPC ..... A41C 1/10; A41C 1/06; A41C 1/08
USPC ..... 450/22, 26, 28, 30, 31, 33, 59, 62, 87, 450/96, 95, 1, 4–10, 12–17, 23, 29, 34–35, 450/41, 55, 60, 61, 63, 70, 155, 111; 2/326, 2/300, 329, 73, 67, 70, 72, 74, 112, 109, 2/107, 110, 308, 311, 304
See application file for complete search history.

(56) References Cited

U.S. PATENT DOCUMENTS

| | | | | | |
|---|---|---|---|---|---|
| 407,341 | A | * | 7/1889 | Ferris | 450/18 |
| 463,050 | A | * | 11/1891 | Harvey | 450/29 |
| 530,692 | A | * | 12/1894 | Kern | 2/112 |
| 561,427 | A | * | 6/1896 | McKay | 2/112 |
| 862,170 | A | * | 8/1907 | Kellogg | 450/29 |
| 865,156 | A | * | 9/1907 | Berggren | 450/14 |
| 1,067,289 | A | * | 7/1913 | Volk | 450/61 |
| 1,115,577 | A | * | 11/1914 | Rochte | 2/112 |
| 1,205,758 | A | * | 11/1916 | Leeman | 450/29 |
| 1,299,957 | A | * | 4/1919 | Kaplan | 450/30 |
| 1,434,231 | A | * | 10/1922 | Louise | 450/29 |
| 1,516,345 | A | * | 11/1924 | Kops | 450/14 |
| 1,522,658 | A | * | 1/1925 | Voorhees | 2/112 |
| 1,524,212 | A | * | 1/1925 | Rebsamen | 450/14 |
| 1,562,128 | A | * | 11/1925 | Stanley | 450/29 |
| 1,655,812 | A | * | 1/1928 | Signe | 450/31 |

(Continued)

FOREIGN PATENT DOCUMENTS

| | | | |
|---|---|---|---|
| DE | 333705 | * | 3/1921 |
| FR | 2647313 | * | 11/1990 |

*Primary Examiner* — Khoa Huynh
*Assistant Examiner* — Brieanna Fuller
(74) *Attorney, Agent, or Firm* — Barry Choobin; Patent360 LLC

(57) ABSTRACT

The various embodiments herein describe a women's undergarment comprising a strapless bra having a body portion with a pair of bust cups extending upwardly from a lower chest band, an underwire support frame provided on the chest band extending to the sides of the bra, two inner bra pads suspended in the bust cups, two straps attached to each of the inner bra pad, a loop provided on sides of the bra for passage of the strap, a panty, a support fabric provided inside the panty and an attachment means provided on one end of the strap for attaching the bra to the support fabric. The straps attached to the support fabric exerts a pulling force on the support fabric causing an upward lift of the support fabric thereby distributing the weight of breasts to lower buttocks and upper thighs of the user.

6 Claims, 11 Drawing Sheets

(56) References Cited

U.S. PATENT DOCUMENTS

| | | | | | |
|---|---|---|---|---|---|
| 1,831,607 | A | * | 11/1931 | Reese | 450/11 |
| 1,891,610 | A | * | 12/1932 | Schiaparelli | 450/32 |
| 1,955,523 | A | * | 4/1934 | Yerkes | 450/1 |
| 2,022,317 | A | * | 11/1935 | Kemp | 450/85 |
| 2,072,839 | A | * | 3/1937 | Robbins | 450/13 |
| 2,079,656 | A | * | 5/1937 | Mirsky | 450/31 |
| 2,118,406 | A | * | 5/1938 | Klin | 450/28 |
| 2,126,591 | A | * | 8/1938 | Voss | 450/13 |
| 2,127,927 | A | * | 8/1938 | McCabe | 450/36 |
| 2,136,768 | A | * | 11/1938 | Willis et al. | 450/13 |
| 2,268,781 | A | * | 1/1942 | Slotoroff | 450/32 |
| 2,315,930 | A | * | 4/1943 | Burke | 450/27 |
| 2,333,268 | A | * | 11/1943 | Moon | 450/13 |
| 2,364,899 | A | * | 12/1944 | Hatton | 450/28 |
| 2,389,450 | A | * | 11/1945 | Moy | 450/6 |
| 2,423,550 | A | * | 7/1947 | McMahon | 2/305 |
| 2,445,144 | A | * | 7/1948 | Leversee | 450/14 |
| 2,508,580 | A | * | 5/1950 | Mixon | 450/41 |
| 2,530,829 | A | * | 11/1950 | Licht | 450/52 |
| 2,626,395 | A | * | 1/1953 | Whitman | 450/28 |
| 2,671,218 | A | * | 3/1954 | Luhr | 450/22 |
| 2,863,460 | A | * | 12/1958 | Monroe | 450/11 |
| 2,869,552 | A | * | 1/1959 | Smith | 450/32 |
| 2,883,988 | A | * | 4/1959 | Lee | 450/46 |
| 3,077,885 | A | * | 2/1963 | Hopper | 450/86 |
| 3,297,035 | A | * | 1/1967 | Wright | 450/31 |
| 3,411,508 | A | * | 11/1968 | Sayers | 450/6 |
| 3,465,754 | A | * | 9/1969 | Lockwood et al. | 450/1 |
| 3,508,555 | A | * | 4/1970 | Bogdon | 450/3 |
| 3,740,765 | A | * | 6/1973 | Delplace | 2/67 |
| 3,982,547 | A | * | 9/1976 | Walker | 450/28 |
| 4,202,343 | A | * | 5/1980 | Ichelson | 450/14 |
| 4,635,640 | A | * | 1/1987 | Sehorn | 450/14 |
| 4,822,317 | A | * | 4/1989 | Wimmer | 450/14 |
| 6,280,287 | B1 | * | 8/2001 | Keith et al. | 450/1 |
| 6,792,620 | B2 | * | 9/2004 | Green | 2/69 |
| 6,811,462 | B1 | * | 11/2004 | Kenneally | 450/30 |
| 7,318,240 | B1 | * | 1/2008 | Rendone | 2/69 |
| 7,343,629 | B2 | * | 3/2008 | Hunt | 2/93 |
| D605,832 | S | * | 12/2009 | Perryman | D2/731 |
| 2008/0076326 | A1 | * | 3/2008 | Wan | 450/41 |
| 2010/0192285 | A1 | * | 8/2010 | Ahn | 2/409 |
| 2012/0090078 | A1 | * | 4/2012 | von Olnhausen | 2/326 |
| 2014/0004771 | A1 | * | 1/2014 | Olumide | 450/59 |

* cited by examiner

UNDERGARMENT WITH A WEIGHT SUSPENSION MEANS

BACKGROUND

1. Technical field

The embodiments herein generally relate to women's undergarments and particularly relate to a support means for undergarments. The embodiments herein more particularly relate to a unitary undergarment with an adjustable weight suspension mechanism for women.

2. Description of the Related Art

Brassieres or bras as more commonly referred to, are garments worn by women to cover and support their breasts. Traditional bras consist of simply cups over the breasts which are held by a chest band that extends around the back and two straps on both sides of the shoulder going from the cups to the back where it attaches to the band and a fastening system for secure attachment of both the ends.

Current bras lift breasts and transfer the weight to the shoulders, neck and back portions of the body. The common problem with a shoulder strap of a bra is that the strap can be misaligned on a wearer's shoulder and, thus, will dig into the shoulder due to the connection of the shoulder strap to the back panel of the bra. Even if the shoulder strap is aligned properly, it may nonetheless become uncomfortable after use due to the shape of the shoulder strap, its alignment with the back panel, and the anatomy of the shoulder and back of the wearer. Further, this shoulder strap can be extremely difficult when the bra has extremely high elastic properties which exist with many bras such as jogging and sports bra.

The provision of fasteners for securing two parts of a garment together in a releasable manner has a number of important requirements especially when the garment is a swimsuit or an item of lingerie such as a bra. However these fasteners should be of sufficient strength to withstand tensile stresses to which it may be subjected, and it must be securely held by the garment part to which it is affixed. While garment fasteners with loops through which straps or strap-like strips of the garment can be passed, have been provided in the past, a variety of problems are associated with them. Firstly, it cannot always be guaranteed that the strap passing through an elongated loop will remain distributed uniformly over the length of the slot. Furthermore, the attachment of the fastener part to the fabric is often unreliable.

In view of the foregoing, there is a need for an undergarment which lifts the breast without applying any pressure on the neck, back or shoulders of the wearer. There is also a need for an undergarment which avoids misalignment of the strap to enhance comfort for the wearer.

The above mentioned shortcomings, disadvantages and problems are addressed herein and which will be understood by reading and studying the following specification.

OBJECTIVES OF THE EMBODIMENTS

The primary object of the embodiments herein is to provide a women's undergarment which elevates weight and pressure from the neck, shoulders and back of the user.

Another object of the embodiments herein is to provide a women's undergarment with a fastener means which can be detachably secured to another garment.

Another object of the embodiments herein is to provide a women's undergarment that functions as a unitary garment for breast support and as a panty that can be comfortably worn in an unrestricted manner.

Another object of the embodiments herein is to provide an undergarment which can be used with any outfit such that its presence underneath the upper garment is inconspicuous and concealed.

Another object of the embodiments herein is to provide an undergarment which improves the posture of the wearer.

These and other objects and advantages of the embodiments herein will become readily apparent from the following detailed description taken in conjunction with the accompanying drawings.

SUMMARY

The various embodiments herein provide a women's undergarment with a weight suspension means. The undergarment comprising a strapless bra having a body portion with a pair of bust cups extending upwardly from a lower chest band, an underwire support frame provided on the lower chest band extending to the sides of the bra, at least two inner bra pads suspended in the bust cups, at least two straps attached to each of the inner bra pads, a loop provided on sides of the bra for passage of the strap, a panty, a support fabric provided inside the panty and an attachment means provided on at least one end of the strap for attaching the bra to the support fabric. The straps attached to the support fabric enables distribution of weight of breasts suspended in the inner bra pads to lower buttocks and upper thighs of the user by exerting a pulling force on the support fabric causing an upward lift of the support fabric.

According to an embodiment herein, the undergarment further comprising an adjuster means provided on the straps for varying length of the straps.

According to an embodiment herein, the strap is non-detachably attached to the inner bra pads.

According to an embodiment herein, the attachment means is at least one of a panty attachment and a suspender attachment.

According to an embodiment herein, the panty attachment is adapted to attach the bra to the panty.

According to an embodiment herein, the suspender attachment is adapted to attach the bra to bottom garments.

According to an embodiment herein, the attaching means is designed to attach the bra to a bottom cloth in a non-permanent fashion.

According to an embodiment herein, the inner bra pads and strap comprise a slide in one-piece form.

According to an embodiment herein, the undergarment further comprises a holder wire, wherein at least one end of the holder wire is connected to the loop and the underwire support frame for holding up the inner bra pads.

According to an embodiment herein, the structural design of the undergarment herein can be varied to accommodate more functional options such as swim wear, sportswear and the like.

According to an embodiment herein, the undergarment is made of a material which is flexible, smooth, and long lasting to provide tear comfort of the wearer.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
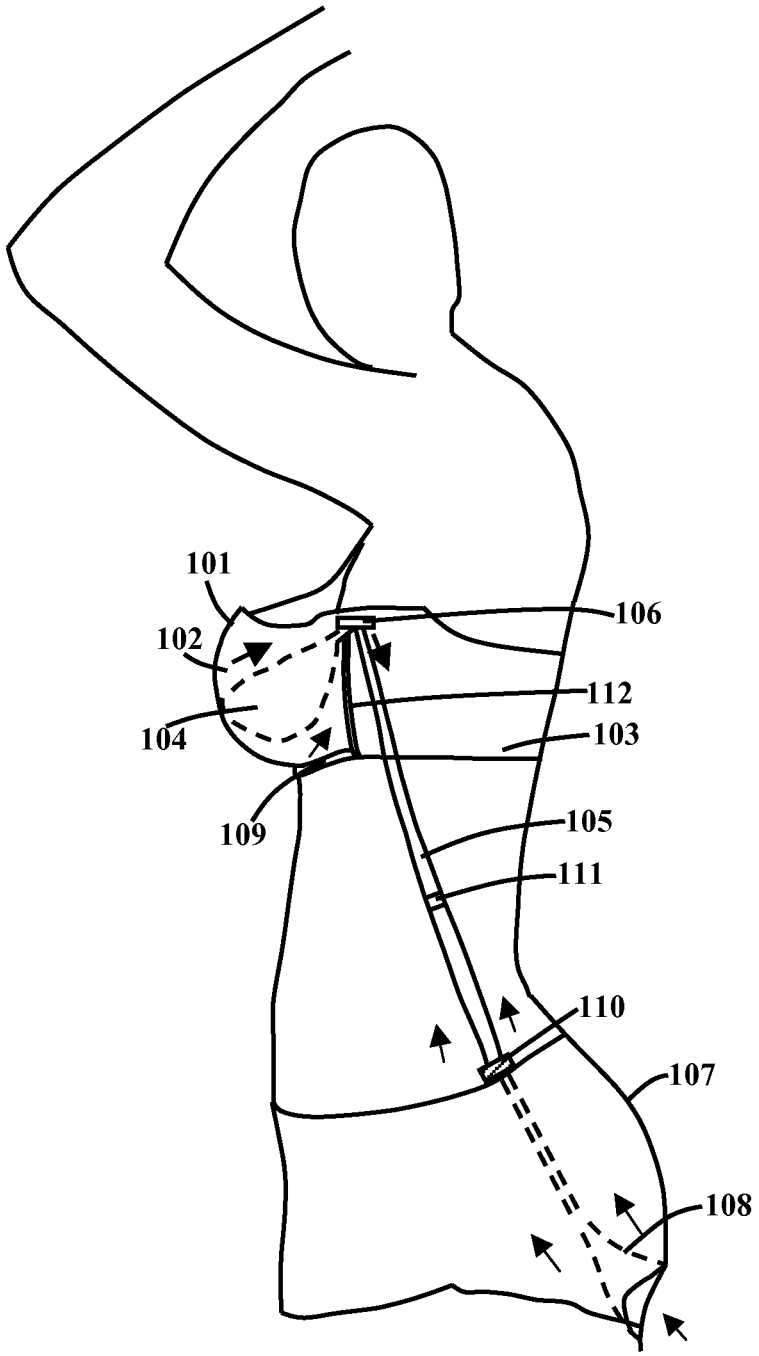
FIG. 1 illustrates a side perspective view of the women's undergarment with a weight suspension means, according to an embodiment herein.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

DETAILED DESCRIPTION OF THE EMBODIMENTS

In the following detailed description, a reference is made to the accompanying drawings that form a part hereof, and in which the specific embodiments that may be practiced is shown by way of illustration. The embodiments herein are described in sufficient detail to enable those skilled in the art to practice the embodiments herein and it is to be understood that the logical, mechanical and other changes may be made without departing from the scope of the embodiments herein. The following detailed description is therefore not to be taken in a limiting sense.

The various embodiments herein provide a women's undergarment with a weight suspension means. The undergarment comprising a strapless bra having a body portion with a pair of bust cups extending upwardly from a lower chest band, an underwire support frame provided on the lower chest band extending to the sides of the bra, at least two inner bra pads suspended in the bust cups, at least two straps attached to each of the inner bra pads, a loop provided on sides of the bra for passage of the strap, a panty, a support fabric provided inside the panty and an attachment means provided on at least one end of the strap for attaching the bra to the support fabric. The straps attached to the support fabric enables distribution of weight of breasts suspended in the inner bra pads to lower buttocks and upper thighs of the user by exerting a pulling force on the support fabric causing an upward lift of the support fabric.

The undergarment further comprises an adjuster means provided on the straps for varying length of the straps. The strap is non-detachably attached to the inner bra pads.

The attachment means is at least one of a panty attachment and a suspender attachment. The panty attachment is adapted to attach the bra to the panty whereas the suspender attachment is adapted to attach the bra to bottom garments.

The attaching means is designed to attach the bra to a bottom cloth in a non-permanent fashion. The inner bra pads and strap comprise a slide in form one-piece. The inner cups and straps can be separated from the bra completely by being pulled through the side openings. Thus the inner cups can be interchanged between with panty attachments or inner cups with suspender attachments.

The undergarment further comprises a holder wire, wherein at least one end of the holder wire is connected to the loop and the underwire for holding up the inner bra pads.

The structural design of the undergarment herein can be varied to accommodate more functional options such as swim wear, sportswear and the like.

The undergarment is made of a material which is flexible, smooth, and long lasting to provide for comfort of the wearer.

FIG. 1 illustrates a side perspective view of the women's undergarment with a weight suspension means, according to an embodiment herein. The undergarment comprises a strapless bra 101, a pair of bust cups 102 extending upwardly from a lower chest band 103, at least two inner bra pads 104 suspended inside the bust cups 102, at least two straps 105 attached to each of the inner bra pads, a loop 106 provided on the sides of the bra for passage of the strap 105, a panty 107 and a support fabric 108 provided inside the panty 107.

The bust cups 102 are made of thin memory foam material and an underwire support frame 109 is provided within the foam material at a region of intersection of the bust cups 102 with the chest band 103. The underwire support frame 109 extends to a holder wire 112, wherein at least one end of the holder wire 112 is connected to the loop 106 and the underwire for holding, up the inner bra pads 104.

The inner bra pads 104 hold the breast and suspend the breasts upward as the straps 105 are pulled downward mimicking a basic pulley system. A downward pull of the straps 105 causes an upward lift of the inner bra pads 104, thus suspending the breasts within the bra. The straps 105 are then attached at both sides of the hips to the support fabric 108 inside the bottom panty 107 through an attachment means say panty attachment 110.

When the straps 105 are attached to the support fabric 108 located around the upper thigh and lower butt, the weight of the breasts is transferred to this support fabric 108 which then lifts the lower buttock, thus transferring the weight to the lower buttocks and upper thighs. In turn this causes a lift of the butt, improving the posture of the wearer.

The straps 105 are further provided with an adjuster means 111 to adjust the length of the strap according to the wearer comfort. This adjuster 111 can be made of plastic, metal or any material of the type. The straps 105 are made of light weight, breathable, smooth, organic and non-stretchable material such as silk and the support fabric of the panty is made of a durable elastic material such as form flex elastic.

Figure 2:
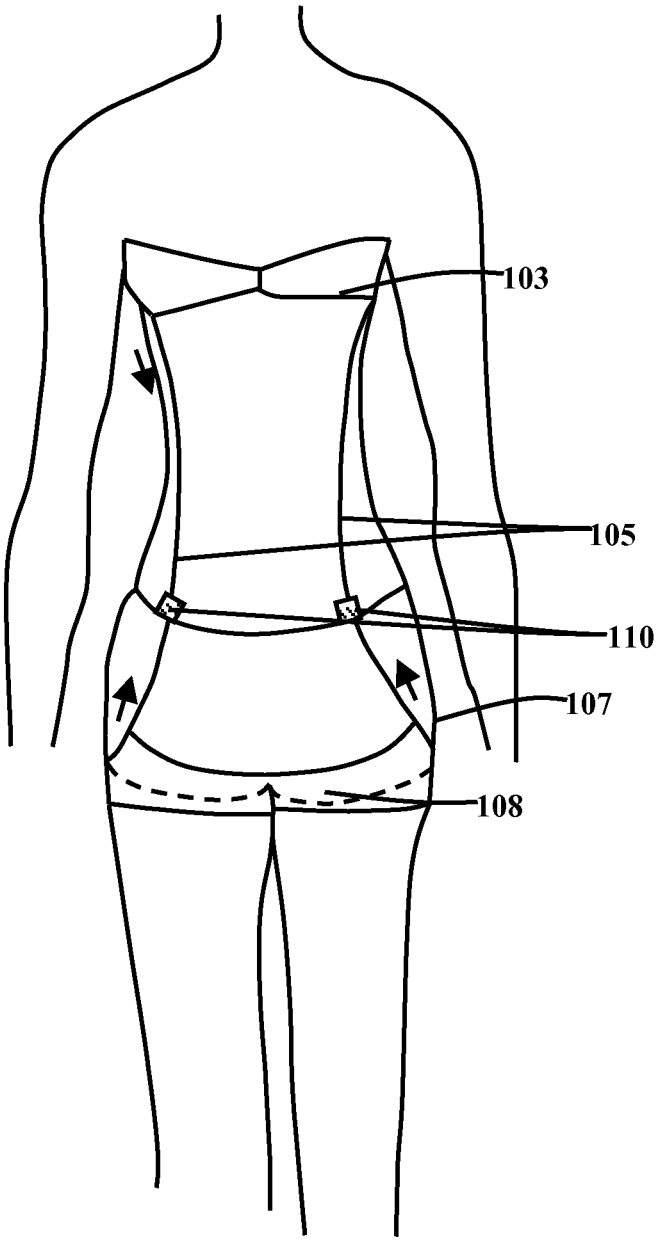
FIG. 2 illustrates a back view of the women's undergarment with a weight suspension means, according to an embodiment herein.

FIG. 2 illustrates a back view of the women's undergarment with a weight suspension means, according to an embodiment herein. The back view shows the back side of the chest band 103, the straps 105 each from the sides of the bra extending downwardly in parallel to waist level and attached to the support fabric 108 through a panty attachment 110. The attachment of the straps 105 with the panty 107 exerts an upward pull on the support fabric 108 inside the panty thereby lifting the lower buttock and transferring the weight to the lower buttocks and upper thighs.

Figure 3A:
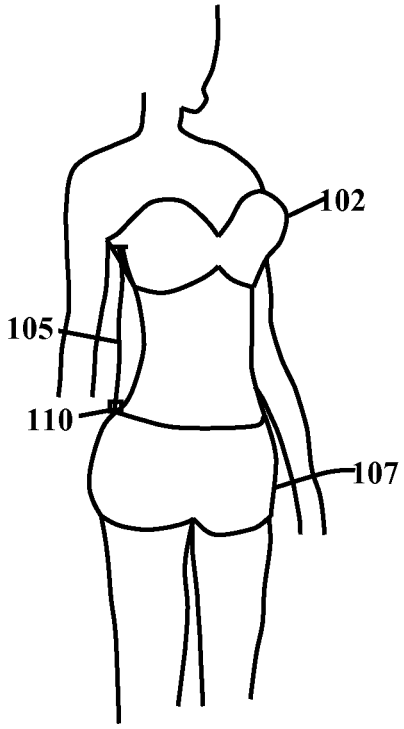
FIG. 3A-3B illustrates a front view and back view of the bra attached to sides of the panty, according to an embodiment herein.
Figure 3B:
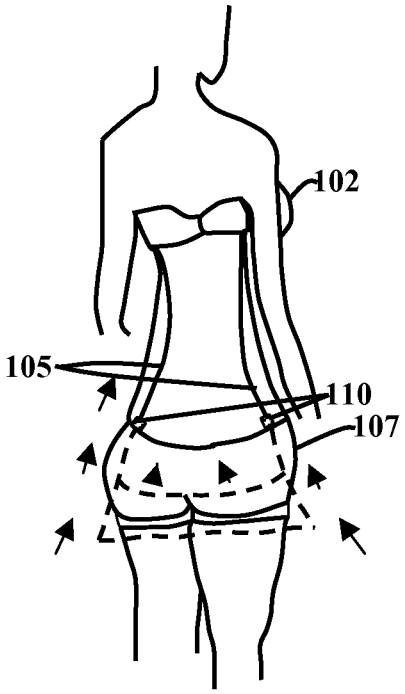

FIG. 3A illustrates a front view of the bra attached to sides of the panty whereas FIG. 3B illustrates a back view of the bra attached to sides of the panty, according to an embodiment herein. The bra 101 has inner bra pads 102 that hold the breasts and are attached to the straps 105 on both sides as shown in FIG. 3A. When the straps 105 are pulled down, the inner bra pads 102 are lifted up, thus suspending the breasts within the bust cups 102. The straps 105 are pulled down through the sides of the bra and attached to the panty 107 through the panty attachment 110 as shown in FIG. 3B. The panty 107 directs the force from the straps 105 down to the upper thighs and the lower buttocks. As the weight from the breast is transferred to stronger muscle group, no pressure is exerted on the sensitive nerves around the neck region. This in turn alleviates weight and stress from the shoulders, neck and back of the wearer.

Figure 4:
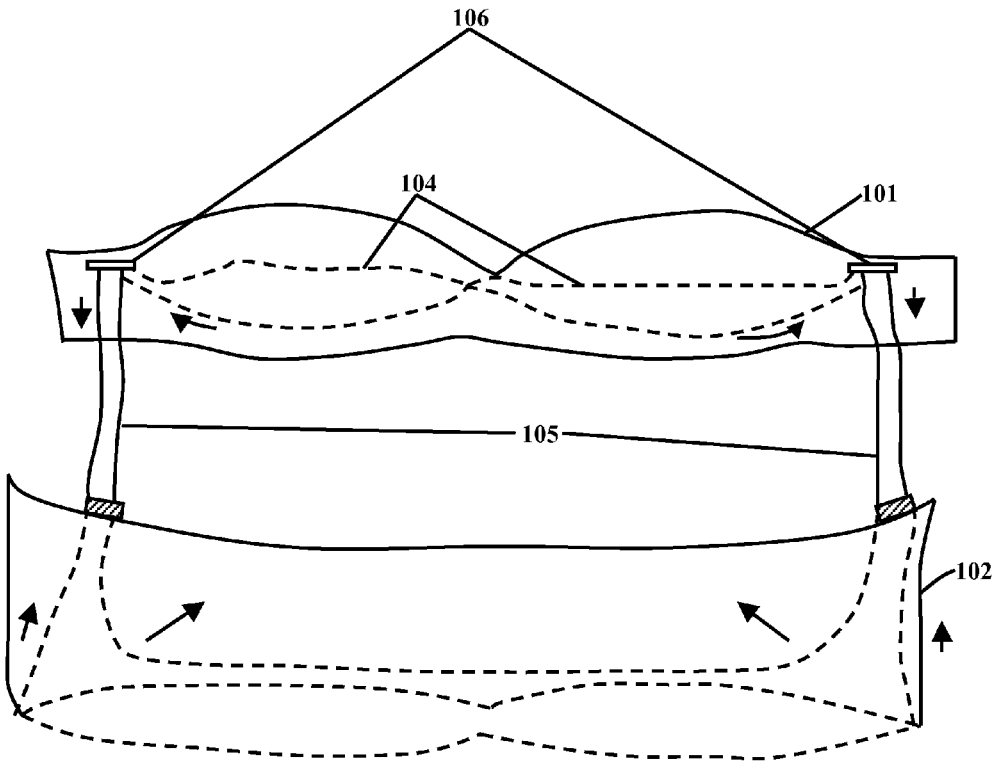
FIG. 4 illustrates a schematic view of the women's undergarment with a panty attachment, according to an embodiment herein.

FIG. 4 illustrates a schematic of the women's undergarment with a panty attachment, according to an embodiment herein. The undergarment comprises a strapless bra 101 and bottom panty 102. The bra 101 comprises a pair of bust cups 102 provided with two inner bra pads 104 which cup the breasts within the bra. These inner bra pads 104 are attached to straps 105 on opposite sides with are located around the arm pits regions. The straps 105 pass through a loop 106 where they can be pulled in and out of. Both straps 105 lead downward to attachment points at the sides of the bottom panty. These attachments direct the pull force from the straps 105 down the lower portion of the butt and the upper thigh portion. The straps 105 are not detachable from the inner bra pads 105, but the inner bra pads 104 and straps 105 can be separated from the bra completely by being pulled through the loops 106 provided on the sides.

Figure 5:
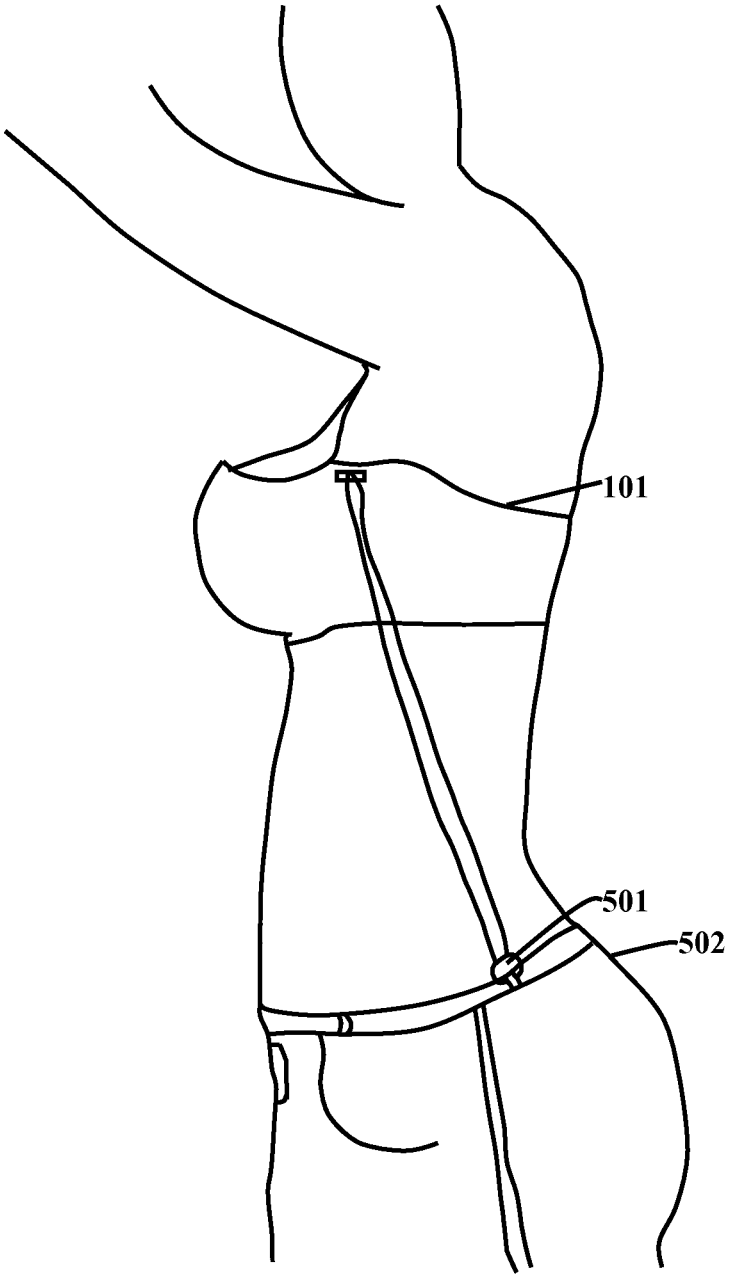
FIG. 5 illustrates a side view of the women's undergarment with a suspender attachment, according to another embodiment herein.

FIG. 5 illustrates a side view of the women's undergarment with a suspender attachment, according to another embodiment herein. The strapless bra 101 is adapted to function with a suspender attachment 501 in addition to the panty attachment 110. The straps 105 extending downward are provided with a suspender attachment 501 which enables the bra to be connected to the bottom garment 502 such as pants, skirts, jeans etc of the user.

The inner bra pads 104 and straps 105 can be separated from the bra completely by being pulled through the side loops 106. Thus the inner bra pads 104 can be interchanged between panty attachments 110 or suspender attachments 501. The straps 105 attached to the bottom garment 502 distributes the weight of the breasts to the waist region of the user thereby does not induce any stress on the neck and shoulder of the wearer.

The suspender attachment 501 is made to fit most bottom garments 502. The suspender attachment 501 can be attached to the belt holes or can be attached by a clip to the bottom garment like traditional suspenders.

Figure 6A:
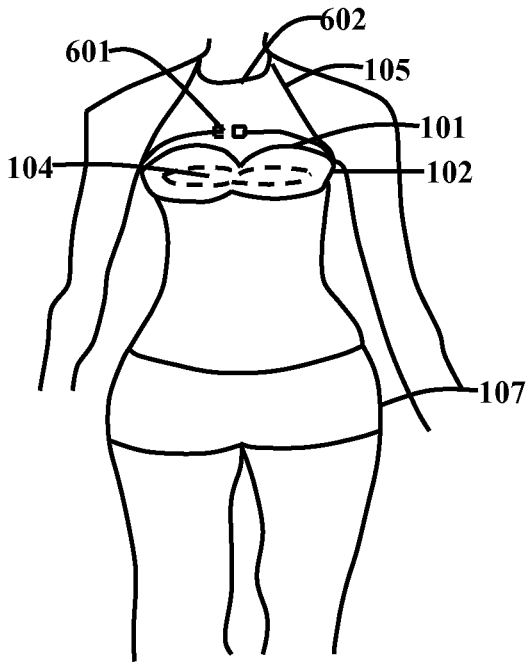
FIG. 6A-6C illustrates a front view, back view and side view of a sport wear design of the women's undergarment with a weight suspension means, according to another embodiment herein.
Figure 6B:
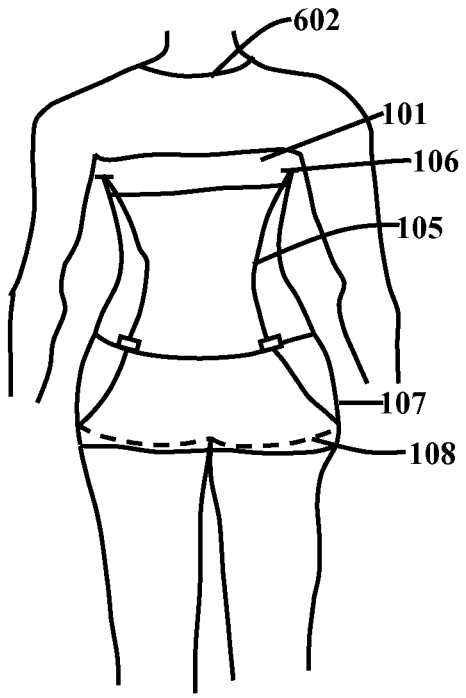
Figure 6C:
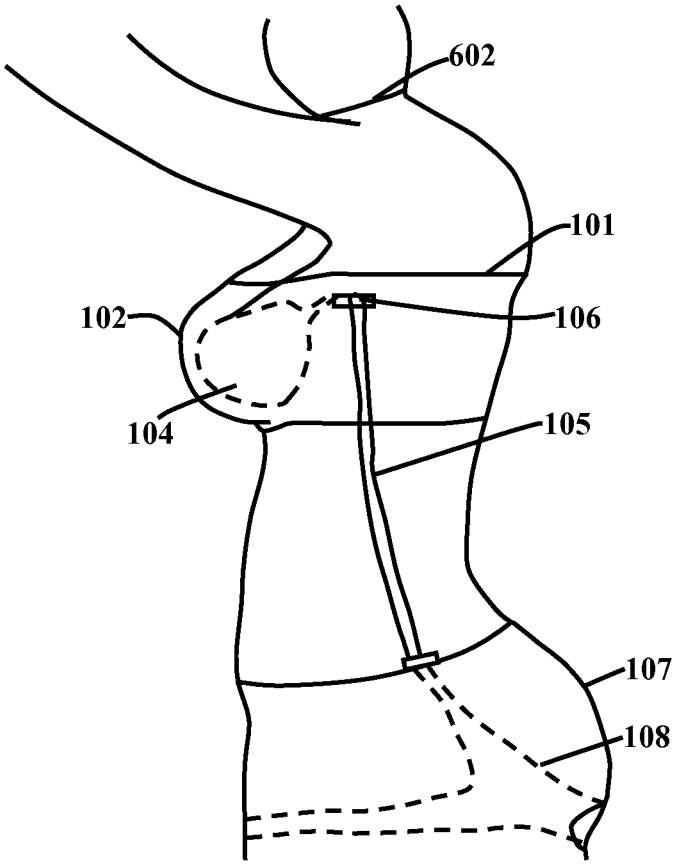

FIG. 6A-6C illustrates a front view, back view and side view of a sport wear design of the women's undergarment with a weight suspension means, according to another embodiment herein. The sportswear design of the undergarment herein includes a strapless bra 101, a pair of bust cups 102, at least two inner bra pads 104 suspended inside the bust cups 102, one or more straps 105 attached to each of the inner bra pads, a loop 106 provided on the sides of the bra for passage of the strap 105, a panty 107 and a support fabric 108 provided inside the panty 107.

The inner bra pads 104 are larger in size to cup more of the breasts. The inner bra pads 104 also have a lock 601 that holds the breasts together at the top. The inner bra pads 104 also include a layer of fabric 602 around the entire front of the bra that leads up to the neck, simply for coverage.

The inner bra pads 104 hold the breast and suspend the breasts. A downward pull of the straps 105 causes an upward lift of the inner bra pads, thus suspending the breasts within the bra. The straps 105 are then attached to both sides of the hips to the bottom panty. This causes a pull in the support fabric 108 which is located around the upper thigh and lower butt. Therefore the force suspending the breasts is transferred downward to the thighs and lower butt. This in turn this causes a lift of the butt. As the weight is transferred to the bottom portion of the body, no pressure is exerted on the neck muscles and shoulders which enables the wearer to move effortlessly.

Figure 7A:
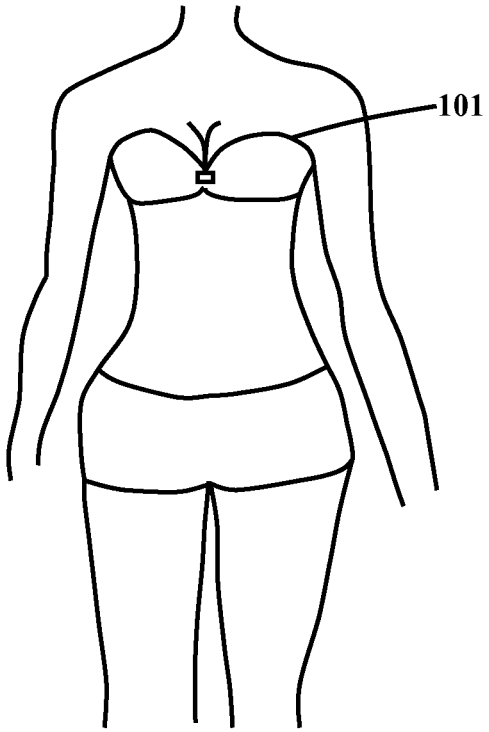
FIG. 7A-7B illustrates a front view and back view of a swim suit design of the women's undergarment with a weight suspension means, according to another embodiment herein.
Figure 7B:
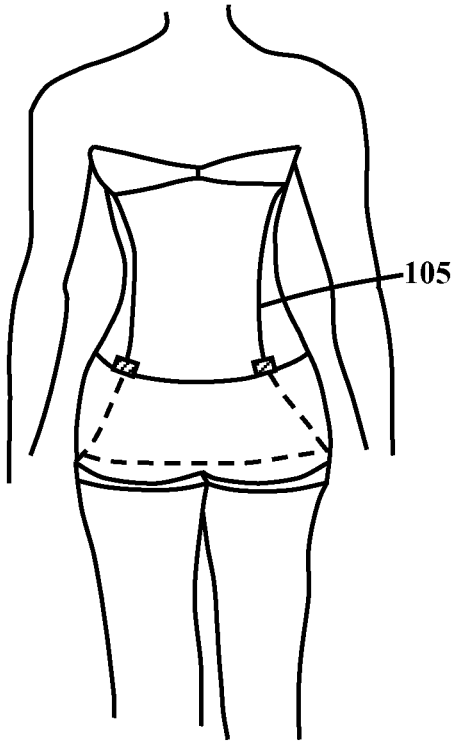

FIG. 7A-7B illustrates a front view and back view of a swim suit design of the women's undergarment with a weight suspension means, according to another embodiment herein. The straps 105 extending downward from the sides of the bra distributes the weight of the breasts to the thighs and buttocks thereby not exerting any stress and pressure on the shoulders and neck muscles of the swimmer. This enables free movement of the shoulders and hands by the swimmer for a better performance.

The various embodiments herein provide a unitary undergarment for women which improve the posture of the wearer by lifting the breast and buttocks and do not induce any stress on the shoulder. The undergarment can be worn with any outfit and the underwear is completely concealed with most outfits. The undergarment includes a strapless bra which transfers weight from breast to a stronger muscle group on the body such that no pressure is applied on the sensitive nerves around the neck region.

The foregoing description of the specific embodiments will so fully reveal the general nature of the embodiments herein that others can, by applying a current knowledge, readily modify and/or adapt for various applications such specific embodiments without departing from the generic concept, and, therefore, such adaptations and modifications should and are intended to be comprehended within the meaning and range of equivalents of the disclosed embodiments.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A women's undergarment with a weight suspension means comprising:

a strapless bra having a body portion with a pair of outer bust cups made of thin memory foam material extending upwardly from a lower chest band;

an underwire support frame provided on the lower chest band extending to each side of the bra;

a pair of inner bra pads suspended in the pair of outer bust cups, and wherein the pair of inner bra pads have a lock to hold the breasts together at top;

at least two straps attached to each of the inner bra pads, and wherein the inner bra pads and the at least two straps comprise a slide in one-piece form, and wherein the at least two straps are pulled down to lift up the pair of inner bra pads to suspend the breasts of a user within the pair of outer bust cups;

a loop provided one each of the sides of the bra for passage of the at least two straps;

a panty;

a support fabric provided inside the panty, and wherein the support fabric is located around the upper thigh and lower butt of the user, and wherein the support fabric is made up of durable elastic material;

an attachment means provided on at least one end of the at least two straps for attaching the bra to the support fabric, and wherein the attachment means is at least one of a panty attachment and a suspender attachment; and a holder wire, and wherein at least one end of the holder wire is connected to one of the loops and the underwire support frame for holding up the inner bra pads;

wherein the at least two straps attached to the support fabric enables distribution of the weight of the breasts suspended in the inner bra pads to the lower buttocks and upper thighs of the user by exerting a pulling force on the support fabric causing an upward lift of the support fabric, wherein the at least two straps attached to the panty distributes the weight of the breasts to the waist region of the user thereby not inducing any stress on the neck, shoulder and back of the user; and wherein the inner bra pads and the at least two straps are separated from the bra completely by being pulled through each of the loops, and wherein the inner bra pads are interchanged between panty attachments and suspender attachments.

2. The undergarment of claim 1, further comprising an adjuster means provided on the at least two straps for varying length of the at least two straps.

3. The undergarment of claim 1, wherein the at least two straps are non-detachably attached to the inner bra pads.

4. The undergarment of claim 1, wherein the panty attachment is adapted to attach the bra to the panty.

5. The undergarment of claim 1, wherein the suspender attachment is adapted to attach the bra to bottom garments.

6. The undergarment of claim 1, wherein the attaching means is designed to attach the bra to a bottom cloth in a non-permanent fashion.

* * * * *